United States Patent [19]

Grimes et al.

[11] Patent Number: 4,615,106

[45] Date of Patent: Oct. 7, 1986

[54] METHODS OF CONSOLIDATING A MAGNETIC CORE

[75] Inventors: Frank H. Grimes, Athens, Ga.; Robert F. Krause, Murrysville Boro, Pa.

[73] Assignee: Westinghouse Electric Corp., Pittsburgh, Pa.

[21] Appl. No.: 716,264

[22] Filed: Mar. 26, 1985

[51] Int. Cl.[4] ..... H01F 7/06

[52] U.S. Cl. ..... 29/605; 29/609; 336/213; 336/234; 427/104; 427/116

[58] Field of Search ..... 29/602 R, 605, 609; 427/104, 116; 336/213, 234

[56] References Cited

U.S. PATENT DOCUMENTS

| | | | |
|---|---|---|---|
| 3,074,039 | 1/1963 | Ford | 336/213 |
| 4,503,605 | 3/1985 | Buckley | 29/605 |
| 4,512,824 | 4/1985 | Taub | 29/605 X |

*Primary Examiner*—Carl E. Hall
*Attorney, Agent, or Firm*—D. R. Lackey

[57] ABSTRACT

A method of consolidating a magnetic core which contains amorphous metal, including the step of thermal spraying an electrically non-conductive material on the edges of the laminations which make up the magnetic core.

12 Claims, 3 Drawing Figures

METHODS OF CONSOLIDATING A MAGNETIC CORE

BACKGROUND OF THE INVENTION

1. Field of the Invention

The invention relates in general to magnetic cores for electrical inductive apparatus, such as transformers and reactors, and more specifically to methods of consolidating magnetic cores containing an amorphous metal.

2. Description of the Prior Art

The use of amorphous metal in the magnetic core of electrical inductive apparatus is desirable when core losses are important, as the core losses in amorphous metal cores are substantially lower than with regular grainoriented electrical steel. Magnetic cores wound from a strip of amorphous metal, however, are not self-supporting, and will collapse if not otherwise supported when the male portion of the winding mandrel is removed from the core window. If an amorphous core is deformed, or otherwise not operated in its as-wound configuration, the core losses increase significantly. Amorphous metal is also very brittle, especially after stress anneal, which is required to optimize the magnetic characteristics of the magnetic core. Care must be taken to properly support the magnetic core during and after stress anneal, such that additional stresses are not introduced into the magnetic core material.

Thus, it would be desirable to economically consolidate such magnetic cores, making them dimensionally stable as well as enabling them to be handled during assembly, and to operate in their intended environment with associated electrical windings, without significantly increasing the core losses. These objectives should be achieved without resorting to box-like core enclosures, costly molds, and the like, as the multiplicity of magnetic core sizes make such "solutions" forbiddenly expensive.

SUMMARY OF THE INVENTION

Briefly, the invention is a new and improved method of consolidating a magnetic core which includes amorphous metal. The method, which is suitable for application to a magnetic core prior to stress anneal, increases the mechanical strength of the magnetic core to make it self-supporting, and it protects the magnetic core against deleterious handling and coil winding stresses. The method includes the step of forming a magnetic core which includes an amorphous metal material, to a predetermined size and configuration. The method further includes the step of thermal-spraying thin overlay deposits of an electrically non-conductive material, such as a ceramic, onto the edges of the magnetic core. The spray deposits are applied in a plurality of passes, to build up an insulative layer on the core edges to a thickness which provides the requisite mechanical bonding and coating strengths, and at a build rate which maintains the temperature of the core material below its crystallization temperature ($T_x$).

BRIEF DESCRIPTION OF THE DRAWINGS

The invention may be better understood and further advantages and uses thereof more readily apparent when considered in view of the following detailed description of exemplary embodiments, taken with the accompanying drawings in which.

DESCRIPTION OF PREFERRED EMBODIMENTS

Figure 1:
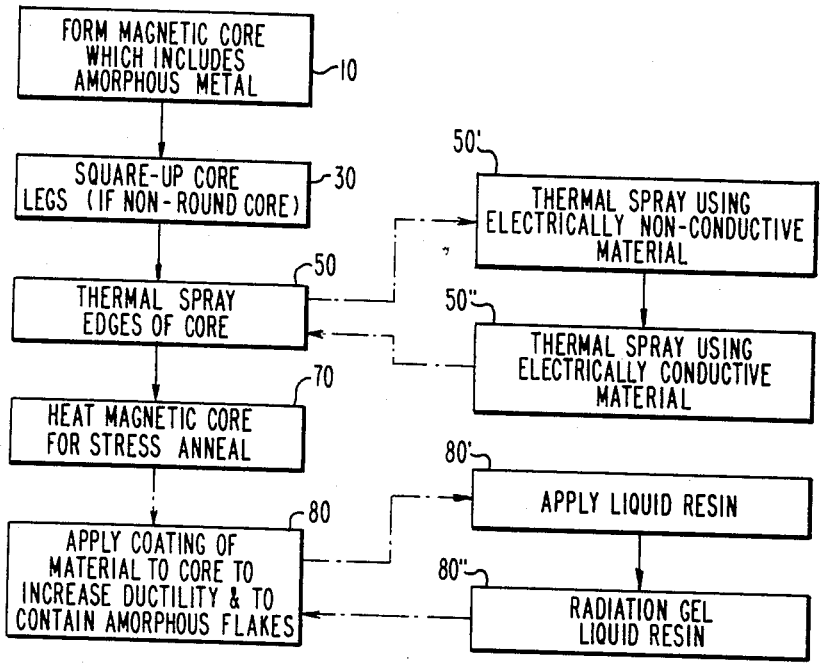
FIG. 1 is a block diagram setting forth method steps of consolidating a magnetic core containing amorphous metal, according to preferred embodiments of the invention.

Referring now to the drawings, there is shown in FIG. 1 a block diagram outlining the steps of consolidating a magnetic core containing an amorphous metal alloy, according to the teachings of the invention. A first step, shown in block 10, includes forming a magnetic core which is either partially or wholly constructed of amorphous metal. For example, the amorphous metal may be Allied Corporation's 2605S-2 material, which is especially suitable for power frequency, low-loss application, but other amorphous alloys may be used. While the method may be applied to bundles of superposed metallic laminations, as used in a stacked magnetic core, the invention is especially suitable for wound cores, and it will be described in this context. Thus, the forming step includes the step of winding a magnetic core from one or more thin elongated strips of metal, at least certain of which are amorphous metal strip, to form a magnetic core having a predetermined size and configuration. For example, the magnetic core may be a ring core for use in constructing a toroidal transformer, or it may have a non-round configuration, including relatively straight leg portions for receiving electrical windings in either a core-form or shell-form arrangement.

Figure 2:
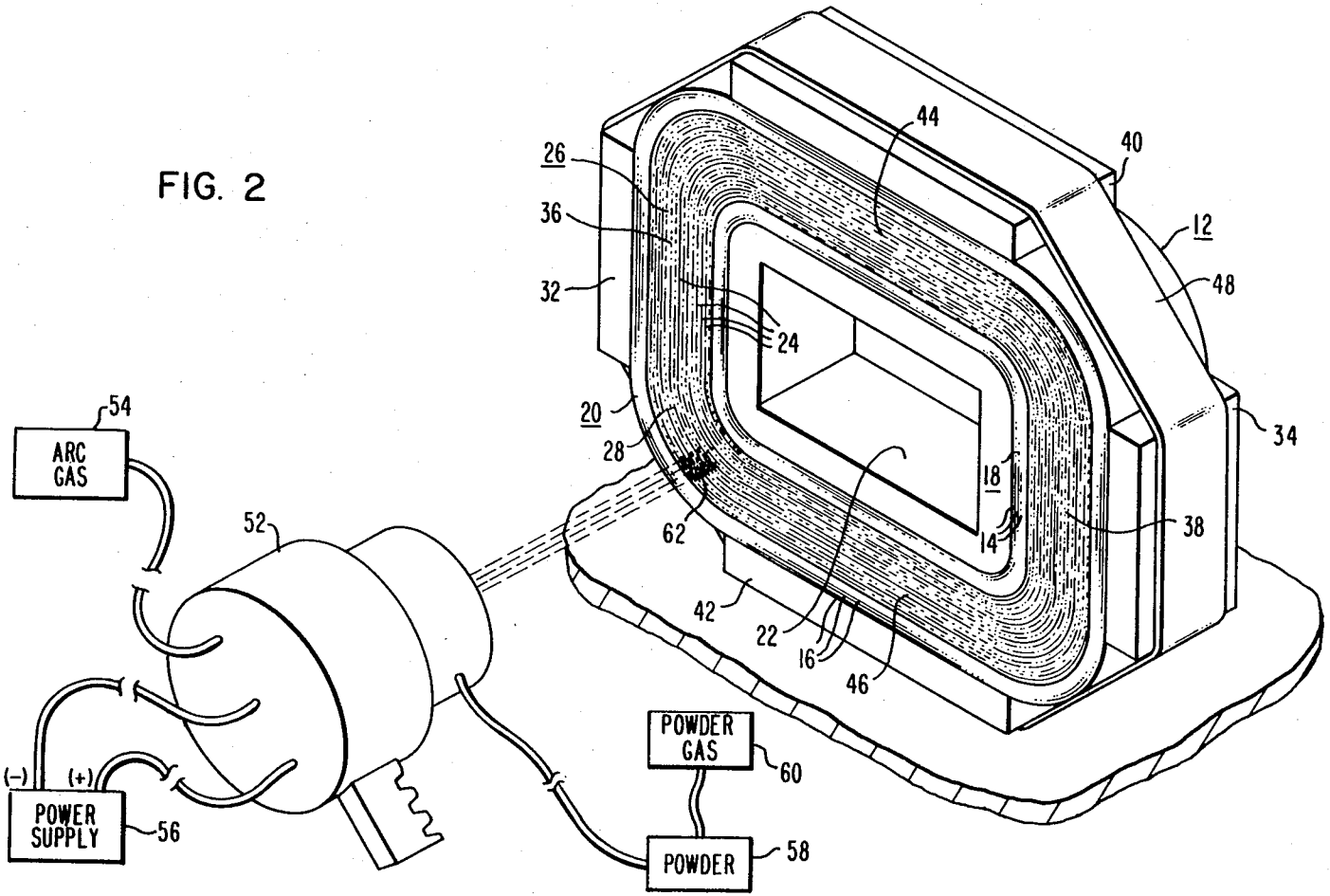
FIG. 2 is a perspective view which illustrates a thermal-spraying step, which is important to the method of the invention.

For example, FIG. 2 illustrates a wound-type mangetic core 12 which, for purposes of example, is illustrated as being a "mixed" core containing both amorphous metal and regular grain-oriented electrical steel. In a mixed core, it is preferable that at least a predetermined number of the innermost and outermost lamination turns be formed of grain-oriented electrical steel, such as lamination turns 14 and 16 which form inner and outer core sections 18 and 20, respectively. The inner core section 18 is wound on a mandrel 22 formed of a material having a coefficient of thermal expansion selected to exert minimal stresses on the core 12 during stress anneal, such as stainless steel. Constructing the inner and outermost lamination turns of a grain-oriented electrical steel adds mechanical strength to the magnetic core, it protects the inner and outer surfaces of the magnetic core during handling and processing, and it reduces the flaking of amorphous metal, which may occur due to the brittleness of amorphous metal, particularly after stress anneal. The grain-oriented electrical steel also reduces the cost of the magnetic core, without a directly proportional increase in core loss, due to the different saturation and loss characteristics, the relative amounts of the two different materials, and the relative lengths of the parallel core loops.

The remaining lamination turns 24 of magnetic core 12 are formed of amorphous metal alloy, to form a central core section 26. However, as hereinbefore stated, the entire magnetic core 12 may be formed of amorphous metal, if desired.

The various lamination turns 14, 16 and 24 form flat sides on opposite sides of magnetic core 12, such as flat side 28. The flat sides expose edges of closely adjacent lamination turns, and it is these flat sides which are edge-bonded according to the methods of the invention, to consolidate the associated magnetic core and hold its desired configuration.

The next step of the method, set forth in block 30 of FIG. 1, is to square-up the core leg and yoke portions, if the core, by design, has a non-round configuration. If the magnetic core is supposed to be round, this step is not necessary. The squaring step of the core legs ensures that the legs are not bowed, and it ensures that the lamination turns are all closely adjacent to one another. As shown in FIG. 2, each straight leg and yoke portion of magnetic core 12 may be clamped and straightened by placing a steel plate against each leg and yoke, such as plates 32 and 34 against yokes 36 and 38, respectively, and plates 40 and 42 against legs 44 and 46, respectively. A steel band 48 is looped about the plates and tightened with a banding tool. Other clamped arrangements, however, may be used, such as a four-way press, for example. The clamping arrangement is utilized only during the consolidating step, and it is removed before the magnetic core is stress annealed.

The next step of the method, shown in block 50 of FIG. 1, includes thermal spraying the edges of the core, i.e., the flat sides defined by the edges of the lamination turns, such as flat side 28 of magnetic core 12. The opposite flat side of magnetic core 12 would also be thermal sprayed. The term "thermal-spraying" as used herein refers to both plasma-arc spraying and flame spraying. Since the lamination turns must not be electrically shorted, the sprayed material should be electrically non-conductive. Also, since it is desirable that the consolidating method be suitable for use before stress anneal, the sprayed material must not lose its bonding and coating strengths at the stress anneal temperature for amorphous metal, which is between about 350° C. and 410° C. for most amorphous alloys of interest. The sprayed material must not unduly stress the magnetic core, either during application or during thermal cycling of the core during use in the associated electrical apparatus. Ceramic coatings meet all of these requirements.

Also, since the amorphous metal will crystallize if heated to its crystallization temperature $T_x$, the method must maintain the temperature of the amorphous metal below this critical temperature, which is about 550° C. for Allied Corporation's 2605S-2. While this last requirement would seem to rule out thermal spraying, it has been found that thermal spraying may not only be used, but the requisite bonding and coating strengths may be achieved, to properly consolidate a magnetic core containing amorphous metal.

In thermal spraying, material in powdered form is metered by a powder feeder or hopper into a gas stream which delivers the material to a flame or arc where it is heated to a molten state and propelled to the lamination edges where mechanical bonding occurs on impact, as the particles solidify. The particles interlock with the edges of the laminations and bond thereto, and they interlock with and bond to one another. Ceramic particles have no cure phase, and thus will not unduly stress and magnetic core because of a volume change. The stress applied to the magnetic core is only that stress which lies below each particle in contact with a core, which is negligible.

In flame spraying, the combustible gas, such as acetylene, propane or oxygen-hydrogen, is used as the heat source to melt the coating material. In plasma-arc spraying, a gas is ionized and electrical current heats the excited gas or plasma to high temperatures controlled by current magnitude. Flame-sprayed coatings exhibit lower bond strengths, higher porosity and higher heat transmittal to the magnetic core than plasma-arc sprayed coatings. Thus, the plasma-arc process, which also produces higher temperatures for melting the powder, and higher particle velocities than flame spraying, is used in the preferred embodiment of the invention shown in FIG. 2. Flame spraying imparts more heat to the substrate, because the deposition rate is 3 to 4 times slower than the rate when using plasma-arc spraying. Also, flame spraying is limited to those ceramics having a melting point under 2760° C.

The plasma-arc process shown in FIG. 2 utilizes a plasma-arc spray gun 52 which may be manipulated manually, or automatically by robot. An inert arc gas 54, such as argon or nitrogen, is introduced into the arc chamber of gun 52, and it is ionized by a high frequency arc starter. The excited gas or plasma then conducts DC current from power supply 56, which is controlled to provide the desired plasma temperature, which is about 10,000° C. where the powder is injected. The powder, indicated at 58, is carried into gun 52 via an inert carrier or powder gas 60, which may be the same as the arc gas. The power level, pressure and flow of the arc gas 54, rate of flow of powder 58 and carrier gas 60, are all controlled by an operator, according to the ceramic powder being utilized and the desired build rate.

It has been found that the temperature of the magnetic core material may be maintained below the crystallization temperature of amorphous metals by rapidly traversing the core surface 28 to build up the coating in a plurality of passes, applying thin overlay upon thin overlay. For example, if a 5 mil coating thickness is desired, the coating would be built up in a plurality of passes applying about 0.5 mil during each pass. The actual final coating thickness is a function of core size, with 3 mils being adequate to consolidate small cores, while 5 or 10 mils is required to consolidate larger magnetic cores. Gun 52 is normally held to spray the deposit 62 at about a 90° angle relative to flat surface 28, with each succeeding pass being made preferably at a right angle to the previously applied overlay. The spraying distance and gun traverse rate should be kept as constant as possible. The distance should be about 4 to 6 inches. If the gun is too close to the substrate, it will cause crazing of the coating, and if the gun is too far away, it reduces the bond and coating strengths. A tolerance of $\pm 2$ mils is easily achieved by hand spraying, and better tolerances may be achieved by automatic or robot spraying. A traverse speed of about 6 in./sec. has been found to be suitable using 800 amperes DC from a plasma spray unit rated 40 KW manufactured by Plasmadyne of Santa Ana, Calif.

Suitable oxides which may be used for the coating deposit which directly contacts the edges of the lamination turns includes mixtures of alumina ($Al_2O_3$) and titanium oxide ($TiO_2$); beryllium oxide (BeO); silicon dioxide ($SiO_2$); and calcium zircanate ($CaZrO_3$). In the interest of promoting heat transfer into the lamination turns from their edges during the stress relief anneal, the coating material in a preferred embodiment is selected to provide the least barrier to heat absorption via radiational heating. Thus, the closer to a black body, the better. Since titanium oxide ($TiO_2$) is black, the mixture of alumina and titanium dioxide powder, such as Metco's 130 SF, is excellent, but other ceramics having a dark color may also be used.

Figure 3:
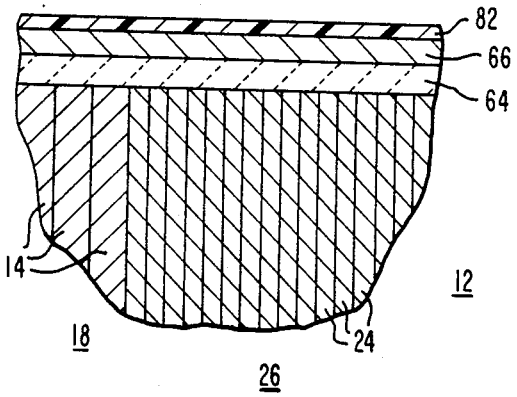
FIG. 3 is a fragmentary, cross-sectional view of a magnetic core containing amorphous metal, illustrating edge-bonding coatings which may be applied to the lamination edges, according to the teachings of the invention.

FIG. 3 is a cross-sectional view through some of the laminations 14 of core section 18 and some of the laminations 24 of core section 26, illustrating how deposit 62 is built up to form a coating 64 on the edges of the lamination turns. In instances where greater mechanical strength is required than achievable via the ceramic coating 64, a composite coating may be formed by thermal spraying a second material over the ceramic coating 64, to provide a coating 66. Since the edges of the lamination turns are electrically insulated by coating 64, coating 66 may be selected for its mechanical strength without regard to its electrical conductivity. Thus, coating 66 may be electrically conductive. An electrically conductive powder which may be used, for example, is Metco's 447. It is a bonding powder containing molybdenum, nickel and aluminum. Steps 50' and 50'' of FIG. 1 illustrate the option of first thermal spraying an electrically non-conductive material on the lamination edges, followed by thermal spraying a different material, which may be electrically conductive, on the coating provided by the electrically non-conductive material.

The next step of the method, shown at 70 in FIG. 1, includes heating the magnetic core while the magnetic core is subjected to a magnetic field, using an inert atmosphere free of oxidizing agents, to relieve the stresses and optimize the magnetic properties of the amorphous metal. This heating step is why the consolidating method of the invention is particularly advantageous, because the method of the present invention permits the magnetic core to be consolidated prior to stress anneal. This solves a problem of how to hold the magnetic cores during anneal, without adding undue stresses to the cores. The temperatures to which the magnetic core is heated depends upon the particular amorphous alloy being used. For example, with Allied's 2605S-2, the core is heated from ambient to 400° C. at a rate between 1° to 10° C. per minute, and it is held for 2 hours at 400° C. The core is then cooled to ambient at a cooling rate between 1° to 10° C. per minute. During the entire cycle, a magnetic field of 10 Oe is applied to the core. The field is usually applied in the direction in which the core will be mangetized during use.

As indicated by block 80 in FIG. 1, after stress relief anneal a coating of material, such as coating 82 shown in FIG. 3, may be applied to either coating 64 or 66, whichever is the outermost coating. Coating 82 may be applied in liquid form, having a viscosity sufficient to impregnate and seal the porous structure of the thermal-spray coatings, or it may be applied in powder form, i.e., electrostatic or fluidized bed. The primary purposes of coating 82 are to increase the ductility of the resulting composite coating, and to contain amorphous flakes and particles, as well as any pieces of the deposit 62 which may spall due to an inadequate bond. As illustrated in alternate steps 80' and 80'' in FIG. 1, a desirable coating may be applied using a radiation gellable liquid resin, such as disclosed in copending application Ser. No. 699,373, filed Feb. 7, 1985, entitled "UV Curable High Tensile Strength Resin Composition". As soon as the liquid resin is applied, it is substantially instantly gelled by electromagnetic radiation, such as ultraviolet light. The gelled resin is advanced from a B-stage to final cure by heat, such as by a separate heating step, or by heat applied during subsequent processing of the magnetic core.

Five magnetic cores were wound from the same reel of amorphous metal, and three of the magnetic cores were consolidated using the plasma-arc spray process hereinbefore described. The core losses per pound at different inductions were measured after stress anneal. The results are listed in the table set forth below. While there exists some scatter in the data, it will be apparent that the plasma-arc spraying process did not impair the magnetic quality of the cores.

TABLE

| | Core Loss in Watts per Pound | | | |
|---|---|---|---|---|
| Sample No. | 10 KG | 12 KG | 13 KG | 15 KG |
| No. 1 (Not Sprayed) | 0.055 | 0.075 | 0.087 | 0.162 |
| No. 2 (Not Sprayed) | 0.055 | 0.075 | 0.089 | 0.178 |
| No. 3 (Sprayed) | 0.050 | 0.067 | 0.078 | 0.151 |
| No. 4 (Sprayed) | 0.049 | 0.068 | 0.082 | 0.152 |
| No. 5 (Sprayed) | 0.062 | 0.084 | 0.098 | 0.170 |

We claim as our invention:

1. A method of consolidating a magnetic core containing amorphous metal having a predetermined stress relief anneal temperature comprising the steps of:

forming a magnetic core having a plurality of lamination layers which define closely adjacent edges on opposite sides of the magnetic core, selecting an electrically non-conductive material suitable for thermal spraying which will solidify and form a coating having bonding and coating strengths which are not deleteriously affected at said predetermined stress relief anneal temperature of said amorphous metal, and thermal spraying said electrically nonconductive material in a molten state such that it solidifies on the edges of the lamination layers, on at least one side of the magnetic core, said thermal-spraying step applying said molten material in a plurality of passes to build up an electrically insulative coating of interlocked solidified particles which bond to the lamination edges and to one another to provide a coating strength sufficient to hold the magnetic core in its sprayed configuration, and with the build rate building up the coating in thin overlays selected to maintain the amorphous metal below its crystallization temperature, and heating the magnetic core after the thermal-spraying step to said predetermined temperature below the crystallization temperature of the amorphous metal to relieve stresses in the magnetic core.

2. The method of claim 1 wherein the step of selecting the spray material for its coating and bonding strength at the predetermined stress relief anneal temperature also selects the material for its heat absorption characteristics, to facilitate heat transfer into the magnetic core via the edges of the laminations during the heating step.

3. The method of claim 1 wherein the forming step includes the step of winding an amorphous strip to form a magnetic core having a non-round configuration which includes straight-leg portions, and including the step of clamping the magnetic core to straighten the leg portions and force the lamination layers closely together during the thermal-spraying step.

4. The method of claim 1 including the step of thermal-spraying a second material on top of the electrically insulative coating, with said second material being different than the material directly applied to the lamination edges, and including the step of selecting said second spray material primarily for its characteristics in increasing the mechanical strength of the resulting composite.

5. The method of claim 4 including the step of heating the magnetic core after the formation of the composite coating, to a temperature below the crystallization temperature of the amorphous metal, to relieve stresses in the magnetic core, and including the step of impregnating the composite, after the heating step, with a material selected to increase the ductility of the composite.

6. The method of claim 1 including the step of impregnating the coating after the heating step, with a material selected to increase the ductility of the composite.

7. The method of claim 4 including the step of heating the magnetic core after the formation of the composite coating, to a temperature below the crystallization temperature of the amorphous metal, to relieve stresses in the magnetic core, and including the step of coating the composite after the heating step, with a material selected to increase the ductility of the composite.

8. The method of claim 1 including the step of coating the spray-applied coating after the heating step, with a material selected to increase the ductility of the composite coating.

9. The method of claim 7 wherein the material applied in the coating step which follows the heating step is a liquid resin gellable by radiation, and including the step of radiation gelling the liquid resin.

10. The method of claim 8 wherein the material applied in the coating step which follows the heating step is a liquid resin gellable by radiation, and including he step of radiation gelling the liquid resin.

11. The method of claim 3 wherein the clamping step is terminated following the thermal-spraying step.

12. A method of claim 4 wherein the second material is electrically conductive.

* * * * *